United States Patent [19]

Osozawa et al.

[11] Patent Number: 4,626,408

[45] Date of Patent: Dec. 2, 1986

[54] NI-BASED ALLOY EXCELLENT IN INTERGRANULAR CORROSION RESISTANCE, STRESS CORROSION CRACKING RESISTANCE AND HOT WORKABILITY

[75] Inventors: Koichiro Osozawa, Yokohama; Rikio Nemoto, Kawasaki; Yoshito Fujiwara, Chigasaki; Tomoaki Okazaki, Hiroshima; Yasuhiro Miura; Kiyoshi Yamauchi, both of Kure, all of Japan

[73] Assignees: Nippon Yakin Kogyo Kabushiki Kaisha; Babock-Hitachi Kabushiki Kaisha, both of Tokyo, Japan

[21] Appl. No.: 652,824

[22] Filed: Sep. 20, 1984

[51] Int. Cl.[4] ..... C22C 19/05

[52] U.S. Cl. ..... 420/442; 420/443; 420/445; 420/447; 420/451; 420/452

[58] Field of Search ..... 420/442, 445, 447, 451, 420/452, 584, 443; 148/427, 428

[56] References Cited

U.S. PATENT DOCUMENTS 4,487,744 12/1984 DeBold et al. ..... 420/584

OTHER PUBLICATIONS

H. R. Copson & G. Economy, "Effect of Some Environmental Conditions on Stress Corrosion Behavior of Ni-Cr Fe Alloys in Pressurized Water", Corrosion, a Journal of Science & Engineering, vol. 24, No. 3, Mar., 1968, pp. 55-65.

*Primary Examiner*—R. Dean

*Attorney, Agent, or Firm*—Balogh, Osann, Kramer, Dvorak, Genova & Traub

[57] ABSTRACT

An alloy prepared by reducing the sulfur content of ASTM UNS N06600 (Trademark Inconel Alloy 600) to an extremely small value and adding specified amounts of Nb and N, and an alloy prepared by reducing the oxygen content of Inconel Alloy 600 and adding specified amounts of Nb, N, B and Mg show a mechanical strength equivalent or superior to that of Inconel Alloy 600 and excellent hot workability, and further has intergranular corrosion resistance and integranular stress corrosion cracking resistance which are far more excellent than those of Inconel Alloy 600.

4 Claims, 4 Drawing Figures

NI-BASED ALLOY EXCELLENT IN INTERGRANULAR CORROSION RESISTANCE, STRESS CORROSION CRACKING RESISTANCE AND HOT WORKABILITY

BACKGROUND OF THE INVENTION

1. Field of the Invention

This invention relates to a Ni-based alloy excellent in intergranular corrosion resistance, stress corrosion cracking resistance, mechanical strength and hot workability, and more particularly, this invention relates to a Ni-based, Cr-containing alloy excellent in intergranular stress corrosion resistance in high-temperature water.

2. Description of the Prior Art

It is described in "Corrosion", Vol. 24, No. 3, p. 55 (1968) that Inconel Alloy 600 (hereinafter referred to briefly as Alloy 600) has stress corrosion cracking susceptibility in high-temperature pure water, which can not be eliminated even when the C content is reduced to 0.02%, and even Ti and Nb for fixing C are not effective in controlling the stress corrosion cracking susceptibility. However, the C content of 0.02% is too high for a Ni-based alloy essentially having a low content of dissolved carbon to be effective in preventing intergranular sensitivity, and the contents of Ti and Nb for fixing carbon are too low for the alloy to be effective in fixing carbon. The intergranular sensitivity can be completely controlled by reducing the carbon content to less than 0.010% or by adding larger amounts of Nb and Ti. However, the carbon content of as low as below 0.010% will bring about a drawback that the mechanical strength is lowered and the yield strength at 0.2% elongation is lowered to below 25 kg/mm$^2$, which is the specification for Alloy 600, while the addition of Nb and Ti in larger amounts will raise the cost and decrease the rate of production.

OBJECT OF THE INVENTION

It is an object of this invention to provide a novel alloy which is free from the drawbacks of Alloy 600 and those of the above various alloys (improved Alloy 600) and is further improved. This object can be achieved by providing an alloy having the following composition.

SUMMARY OF THE INVENTION

This invention provides the following two basic alloys: a Ni-based alloy comprising 25% or less of Fe, 14 to 26% of Cr, 0.045% or less of C, 1.0% or less of Si, 1.0% or less of Mn, 0.03% or less of P, 0.0010% or less of S, 0.005 to 0.2% of N, 0.05 to 4.0% of Nb, the Nb being present in an amount satisfying the relationships: % Nb$\geqq$100 (% C$-$0.005) % in case where % C is more than 0.0055% and % Nb$\geqq$[3.0$-$75 (% C+% N)] % in case where (% C+% N) is less than 0.04%, and the balance consisting substantially of Ni: and when S among the above components of the above alloy is contained in an amount of as large as 0.030% or less a Ni-based alloy further contains 0.001 to 0.010% of B, 0.005 to 0.05% of Mg, and below 0.0060% or less of O, and the balance consisting substantially of Ni: and an alloy which is at least one member selected from the above two basic alloys and further contains at least one component selected from the group consisting of Ti, Al and Zr, each of the Ti and Zr being present in an amount of 0.05 to 1% and the Al being present in an amount of 0.01 to 1%, and the total of the content of these metals is 1% or less. The alloys of this invention are excellent in intergranular corrosion resistance, stress corrosion cracking resistance, mechanical strength, and hot workability.

BRIEF DESCRIPTION OF THE DRAWINGS

This invention will now be described with reference to accompanying drawings wherein.

DETAILED DESCRIPTION OF PREFERRED EMBODIMENTS

Figure 1:
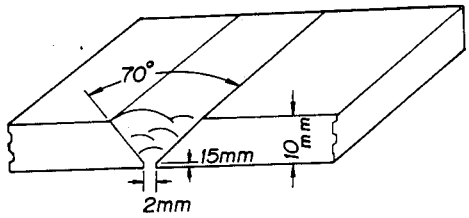
FIG. 1 is a perspective view of a test piece for a corrosion test.

As described above, the alloys of this invention include a Ni-based, Cr-containing alloy and a Ni-based, Cr-Fe-containing alloy, and especially an alloy in which the contents of S, Nb, C, N, Ti, Al, Zr, B, Mg, and O are limited within specified ranges in order to improve the intergranular corrosion resistance, intergranular stress corrosion cracking resistance, mechanical strength, and hot workability of Alloy 600.

Description will be made of the reason why the composition of the alloy of this invention must be limited.

When the C content is higher than 0.045%, the corrosion resistance of a welded zone is lowered. By the way, although the above-mentioned lowering in corrosion resistance can be prevented by adding a larger amount of Nb, the hot workability is lowered. Therefore, the C content must be at most 0.045%, and when it is 0.030% or below, the hot workability is particularly good.

When the Mn content is higher than 1.0%, the intergranular corrosion resistance is lowered and, therefore, the Mn content must be at most 1.0%.

When the P content is higher than 0.030%, the intergranular corrosion resistance and weldability are lowered and, therefore, the P content must be at most 0.030%.

In case of the alloy of this invention containing none of B and Mg, the hot workability is markedly lowered when the S content is higher than 0.0010%. Therefore, the S content must be at most 0.0010%. In case of the alloy of this invention containing both of B and Mg, the hot workability is lowered when the S content is higher than 0.030%. Therefore, the S content must be at most 0.030%.

Cr is an element necessary to attain the desired corrosion resistance. When the Cr content is lower than 14%, the corrosion resistance is lowered, while when it is higher than 26%, the high-temperature strength is heightened, so that the rate of production is lowered. Therefore, the Cr content must be in the range of 14 to 26%.

When the Fe content is higher than 25%, the transgranular stress corrosion cracking resistance in a solution containing a chloride is lowered. Therefore, the Fe content must be at most 25%.

Nb is an element which serves to enhance the intergranular corrosion resistance, intergranular stress corrosion cracking resistance and mechanical strength. When the Nb content is lower than 0.05%, the above-mentioned enhancement in the intergranular corrosion resistance and mechanical strength can not be achieved, while when it is higher than 4.0%, the hot workability is lowered. Therefore, the Nb content must be in the range of 0.05 to 4.0%. Further, when the Nb content is lower than 100 (% C—0.005) % in case where % C is more than 0.0055%, the corrosion resistance of a welding heat-affected zone is lowered. Therefore in case where % C is more than 0.0055%, the Nb content must be at least 100 (% C—0.005) %. On the other hand, when the Nb content is lower than [3.0—75 (% C+% N)] % in case where (% C+% N) is less than 0.04%, the mechanical strength is lowered. Therefore, in case where (% C+% N) is less than 0.04%, the Nb content must be at least [3.0—75 (% C+% N)] %.

N is an element which serves to enhance the mechanical strength, intergranular corrosion resistance and intergranular stress corrosion cracking resistance. When the N content is lower than 0.005%, the above-mentioned properties can not be enhanced, while when it is higher than 0.2%, this exceeds the solubility limit of N, leading to the formation of blowholes. Therefore, the N content must be in the range of 0.005 to 0.2%.

Ti, Zr and Al are each an element which, as a deoxidizer, improves the hot workability, and especially, Ti and Zr are elements which prevent the formation of blowholes and serve to enhance the corrosion resistance of a welding high-temperature heat-affected zone. When the Ti and Zr contents are each lower than 0.05%, or when the Al content is lower than 0.01%, the above-mentioned enhancement of corrosion resistance can not be obtained. When the Ti, Zr and Al contents are each higher than 1%, or when the total content of these elements is higher than 1%, the above-mentioned enhancement of corrosion resistance can not be obtained. Therefore, the Ti and Zr contents must be each in the range of 0.05 to 1%, and the Al content must be in the range of 0.01 to 1%, and the upper limit of the total content of these elements must be 1%.

B and Mg are elements which serve to enhance the hot workability. When the B and Mg contents are lower than 0.001% and 0.005%, respectively, the hot workability can not be enhanced, while when they are higher than 0.010% and 0.05%, respectively, the hot workability is rather lowered. Therefore, the B content must be in the range of 0.001 to 0.010%, and the Mg content must be in the range of 0.005 to 0.05%.

The O content of higher than 0.0060% will reduce the effect of B in enhancing the hot workability. Therefore, the O content must be at most 0.0060%.

The sum of contents of all these elements exclusive of Ni is not more than 50%.

The alloy of this invention will now be described with reference to experimental data, which are compared with those on conventional alloys.

The alloys (Nos. 1 to 11) of this invention and comparative alloys (Nos. 12 to 15) having compositions shown in Table 1 were smelted into 6 to 10 kg alloy ingots by using an induction furnace and these ingots were forged into pieces each 10 mm thick and 70 to 100 mm wide. These pieces were heated at 1100° C. for one hour, and then cooled with water. They were further heated at 870° C. for two hours, and then cooled with water. Test pieces for mechanical tests were prepared from the obtained steel pieces. As shown in FIG. 1, a groove was prepared in each of the steel pieces and padded in layers with a filler metal having a composition as shown in Table 2 by TIG arc welding. These alloy pieces were heated at 600° C. for 20 hours, then cooled in air, further heated at 500° C. for 40 hours, and cooled in air. From these treated alloy pieces, test pieces for a corrsoion test were prepared. All of the above test pieces were cut to form crosssections for welding zones to which the final finishing was applied by wet polishing with #800.

TABLE 1

| | (%) | | | | | | | | | | | | | | | |
|---|---|---|---|---|---|---|---|---|---|---|---|---|---|---|---|---|
| | C | Si | Mn | P | S | Ni | Cr | Fe | Nb | N | B | Mg | O | Ti | Zr | Al |
| This invention | | | | | | | | | | | | | | | | |
| Alloy No. 1 | 0.020 | 0.19 | 0.20 | 0.005 | 0.0010 | bal. | 16.95 | 6.12 | 1.62 | 0.029 | — | — | — | — | — | — |
| Alloy No. 2 | 0.010 | 0.02 | 0.21 | 0.006 | 0.0008 | " | 15.50 | 7.20 | 2.30 | 0.030 | — | — | — | 0.32 | — | — |
| Alloy No. 3 | 0.025 | 0.22 | 0.32 | 0.008 | 0.0006 | " | 16.53 | 7.06 | 2.75 | 0.008 | — | — | — | — | 0.21 | 0.12 |
| Alloy No. 4 | 0.007 | 0.23 | 0.21 | 0.006 | 0.0025 | " | 16.41 | 7.00 | 1.52 | 0.020 | 0.0043 | 0.006 | 0.0035 | — | — | — |
| Alloy No. 5 | 0.031 | 0.02 | 0.05 | 0.010 | 0.0010 | " | 16.22 | 7.50 | 3.21 | 0.006 | 0.0022 | 0.010 | 0.0021 | — | — | — |
| Alloy No. 6 | 0.020 | 0.15 | 0.26 | 0.007 | 0.0035 | " | 16.30 | 7.21 | 2.52 | 0.015 | 0.0020 | 0.005 | 0.0015 | — | — | — |
| Alloy No. 7 | 0.013 | 0.20 | 0.25 | 0.007 | 0.0030 | " | 16.45 | 7.10 | 2.70 | 0.010 | 0.0025 | 0.008 | 0.0025 | — | — | 0.10 |
| Alloy No. 8 | 0.015 | 0.30 | 0.24 | 0.004 | 0.0025 | " | 23.21 | 12.05 | 2.28 | 0.112 | 0.0015 | 0.012 | 0.0042 | 0.30 | — | 0.08 |
| Alloy No. 9 | 0.021 | 0.10 | 0.41 | 0.009 | 0.0030 | " | 15.42 | 6.50 | 2.78 | 0.035 | 0.0032 | 0.006 | 0.0048 | 0.40 | 0.11 | 0.05 |
| Alloy No. 10 | 0.006 | 0.22 | 0.22 | 0.009 | 0.0023 | " | 16.55 | 7.02 | 2.08 | 0.019 | 0.0046 | 0.005 | 0.0053 | — | — | 0.21 |
| Alloy No. 11 | 0.008 | 0.21 | 0.19 | 0.008 | 0.0032 | " | 16.32 | 6.40 | 0.52 | 0.030 | 0.0035 | 0.010 | 0.0024 | — | 0.55 | — |
| Comparative | | | | | | | | | | | | | | | | |
| Alloy No. 12 | 0.065 | 0.36 | 0.19 | 0.002 | 0.0004 | " | 15.95 | 6.09 | — | 0.004 | — | — | — | 0.36 | — | 0.21 |
| Alloy No. 13 | 0.004 | 0.21 | 0.30 | 0.007 | 0.0030 | " | 16.20 | 7.01 | — | 0.008 | — | — | — | — | — | — |
| Alloy No. 14 | 0.033 | 0.42 | 0.58 | 0.008 | 0.0021 | " | 21.53 | 15.02 | — | 0.004 | 0.0026 | 0.010 | 0.0083 | — | — | 2.15 |
| Alloy No. 15 | 0.008 | 0.23 | 0.22 | 0.007 | 0.0028 | " | 16.37 | 7.07 | 2.03 | 0.008 | 0.0020 | 0.005 | 0.0096 | — | — | — |

TABLE 2

| | (%) | | | | | | | | | |
|---|---|---|---|---|---|---|---|---|---|---|
| | C | Si | Mn | P | S | Ni | Cr | Fe | Nb | Ni |
| Filler metal | 0.01 | 0.11 | 2.96 | 0.005 | 0.002 | Bal. | 20 | 0.90 | 2.60 | 0.36 |

TABLE 3

| Sample | Yield strength at 0.2% elongation ($kg/mm^2$) | Intergranular corrosion test 50% $H_2SO_4$ + 83 g $Fe_2(SO_4)_3$/l boil, 24 hours | High-temperature water stress corrosion cracking test 290° C., 500 h, weight of oxygen dissolved in the solution 40 ppm | Hot workability Hot-forging |
|---|---|---|---|---|
| This invention | | | | |
| Alloy No. 1 | 26.5 | 0 | 0 | 0 |
| Alloy No. 2 | 29.0 | 0 | 0 | 0 |
| Alloy No. 3 | 28.5 | 0 | 0 | 0 |
| Alloy No. 4 | 27.0 | 0 | 0 | 0 |
| Alloy No. 5 | 30.2 | 0 | 0 | 0 |
| Alloy No. 6 | 28.8 | 0 | 0 | 0 |
| Alloy No. 7 | 27.8 | 0 | 0 | 0 |
| Alloy No. 8 | 33.5 | 0 | 0 | 0 |
| Alloy No. 9 | 31.2 | 0 | 0 | 0 |
| Alloy No. 10 | 27.2 | 0 | 0 | 0 |
| Alloy No. 11 | 26.8 | 0 | 0 | 0 |
| Comparative | | | | |
| Alloy No. 12 | 25.5 | X | X | 0 |
| Alloy No. 13 | 18.9 | 0 | 0 | X |
| Alloy No. 14 | 24.0 | X | X | X |
| Alloy No. 15 | 26.0 | 0 | 0 | X |
| | | 0: penetration rate $d < 0.5$ X: penetration rate $d \geqq 0.5$ | 0: not cracked X: cracked | 0: not cracked X: cracked |

Table 3 shows the results of yield strength at 0.2% elongation, intergranular corrosion test, high-temperature water stress corrosion cracking test, and a test for crackings after hot forging. With respect to the test pieces which had been subjected to the intergranular corrosion test and to the high-temperature water stress corrosion cracking test, they were observed by means of an optical microscope, and with respect to the test pieces which had been subjected to the intergranular corrosion test, their maximum penetration rate, d, were measured, while the test pieces which had been subjected to the high-temperature stress corrosion cracking test were examined for the presence of crackings.

Table 3 shows that each of the alloys (Nos. 1 to 11) of this invention showed a mechanical strength (yield strength at 0.2% elongation) exceeding 25 $kg/mm^2$, which was the specification for Alloy 600, and a penetration rate of intergranular corrosion test of 0.5 mm/day or below, and did not give any cracking in the high-temperature water stress corrosion cracking test. In hot working, each of the alloys (Nos. 1 to 11) of this invention was forged without cracking. On the other hand, a comparative alloy No. 12 showed a penetration rate of intergranular corrosion test exceeding 0.5 mm/day and gave cracking in the high-temperature water stress corrosion cracking test and further gave cracking in hot forging. A comparative alloy No. 13 showed a yield strength at 0.2% elongation of below 25 $kg/mm^2$ and gave cracking in hot forging. A comparative alloy No. 14 showed a yield strength at 0.2% elongation of below 25 $kg/mm^2$, a penetration rate of intergranular corrosion test exceeding 0.5 mm/day, and gave cracking in the high-temperature water corrosion test and hot forging. A comparative alloy No. 15 gave cracking in hot forging.

Figure 2:
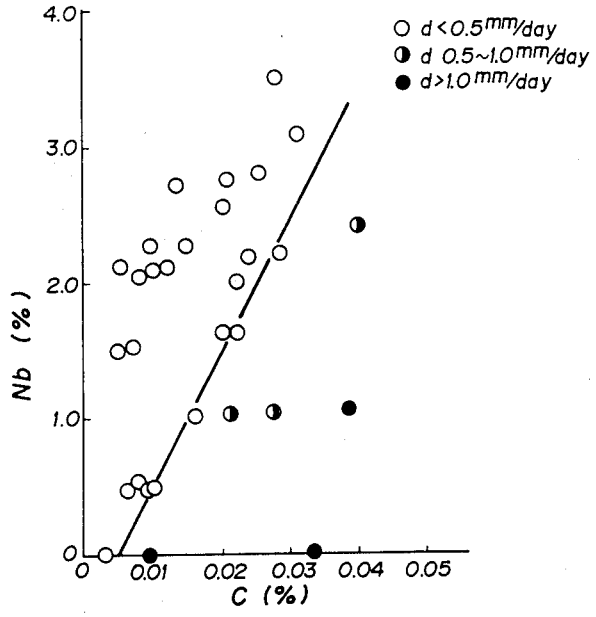
FIG. 2 is a diagram showing a relationship between the intergranular corrosion and the contents (%) of Nb and C.

FIG. 2 is a diagram showing a relationship between the intergranular corrosion and the contents (%) of Nb and C, wherein mark O indicates a test piece showing a maximum penetration rate, d, of below 0.5 mm/day, mark indicates a test piece showing the above-mentioned d of 0.5 to 1 mm/day, and mark indicates a test piece showing the above-mentioned d of above 1 mm/day. This figure shows that in order to obtain an alloy showing a maximum penetration rate, d, of below 0.5 mm/day, it is necessary to add at least 100 (% C−0.005) % of Nb in case where % C is more than 0.0055%.

Figure 3:
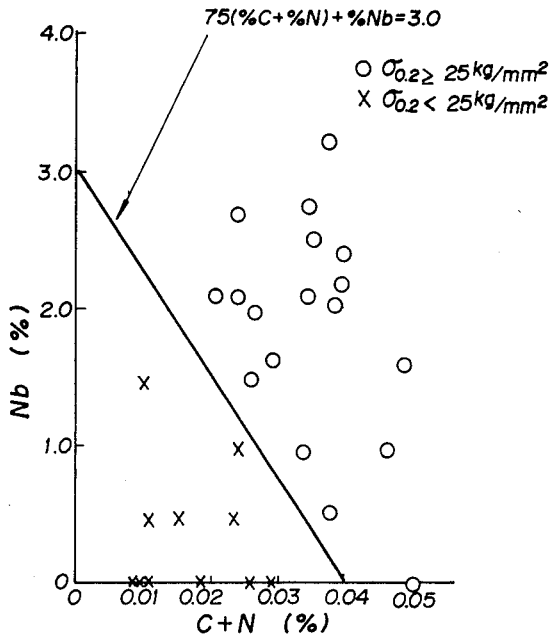
FIG. 3 is a diagram showing a relationship between the yield strength at 0.2% elongation and the contents (%) of Nb and (C+N)

FIG. 3 is a diagram showing a relationship between the yield strength at 0.2% elongation ($\sigma_{0.2}$) and the contents of Nb and (C+N), wherein mark O indicates a test piece showing $\sigma_{0.2}$ exceeding 25 $kg/mm^2$, and mark X indicates a test piece showing $\sigma^{0.2}$ not exceeding 25 $g/mm^2$. This figure shows that in order to obtain an alloy showing $\sigma_{0.2}$ exceeding 25 $kg/mm^2$, which is the specification for the yield strength at 0.2% elongation of Alloy 600, it is necessary to add at least [3.0−75 (% C+% N)] % of Nb in case where (% C+% N) is less than 0.04%.

Figure 4:
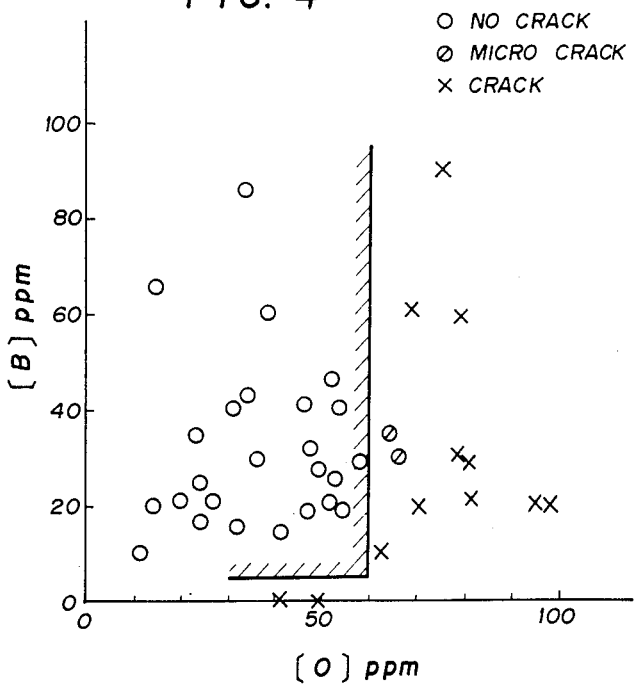
FIG. 4 is a diagram showing a relationship between the hot workability and the contents (%) of O and B.

FIG. 4 is a diagram showing a relationship between the oxygen and boron contents of the alloy (No. 7) of this invention (an alloy containing 0.003% of S, and 2.7% of Nb) and hot workability, wherein mark X indicates an alloy which cracked in the working, mark $\phi$ indicates an alloy which slightly cracked in the working, and mark O indicates an alloy which did not crack in the working. This figure shows that in order to obtain an alloy having a specified hot workability, it is necessary to reduce the O content to 60 ppm or below.

What is claimed is:

1. A Ni-based alloy excellent in intergranular corrosion resistance, stress corrosion cracking resistance and hot workability, consisting essentially of 25% or less of Fe, 14 to 26% of Cr, 0.045% or less of C, 1.0% or less of Si, 1.0% or less of Mn, 0.030% or less of P, 0.0010% or less of S, 0,005 to 0.2% of N, 0.05 to 4.0% of Nb, said Nb being present in an amount satisfying the relationships: % Nb≧100 (% C−0.005) % in case where % C is more than 0.0055% and % Nb=[3.0−75 (% C+% N)] % in case where (% C+% N) is less than 0.04%, sum of all said elements exclusive of Ni being not more than 40%, and the balance consisting of Ni.

2. An alloy as defined in claim 1, which further contains at least one member selected from the group consisting of Ti, Al and Zr, each of Ti and Zr being present in an amount of 0.05 to 1%, Al being present in an amount of 0.01 to 1%, and the upper limit of the total content of these metals being 1%, sum of contents of all said elements exclusive of Ni being not more than 40%, and the balance consisting of Ni.

3. A Ni-based alloy excellent in intergranular corrosion resistance, stress corrosion cracking resistance and hot workability, consisting essentially of 25% or less of Fe, 14 to 26% of Cr, 0.045% or less of C, 1.0% or less of Si, 1.0% or less of Mn, 0.030% or less of P, 0.030% or less of S, 0.005 to 0.2% or N, 0.05 to 4.0% of Nb, said Nb being present in an amount satisfying the relationships: % Nb≧100 (% C−0.005) % in case where % C is more than 0.0055% and % Nb=[3.0−75 (% C+% N ] % in case where (% C+% N) is less than 0.04%, 0.001 to 0.010% of B, 0.005 to 0.05% of Mg, 0.0060% or less of O, sum of contents of all said elements exclusive of Ni being not more than 40%, and the balance consisting of Ni.

4. An alloy as defined in claim 3, which further contains at least one member selected from the group consisting of Ti, Al and Zr, each of Ti and Zr being present in an amount of 0.05 to 1%, Al being present in an amount of 0.01 to 1%, and the upper limit of the content of these metals being 1%, sum of contents of all said elements exclusive of Ni being not more than 40%, and the balance consisting of Ni.

* * * * *